US008075323B2

(12) United States Patent
Okuyama et al.

(10) Patent No.: US 8,075,323 B2
(45) Date of Patent: Dec. 13, 2011

(54) CONNECTOR HAVING A PLUG ARRANGED ABOVE A PLATE-LIKE TERMINAL

(75) Inventors: Takeshi Okuyama, Tokyo (JP); Tadashi Kumamoto, Tokyo (JP); Kazuhiro Mizukami, Tokyo (JP); Toshihiro Kusagaya, Tokyo (JP)

(73) Assignee: Fujisu Component Limited, Tokyo (JP)

( * ) Notice: Subject to any disclaimer, the term of this patent is extended or adjusted under 35 U.S.C. 154(b) by 0 days.

(21) Appl. No.: 13/083,679

(22) Filed: Apr. 11, 2011

(65) Prior Publication Data

US 2011/0250799 A1 Oct. 13, 2011

(30) Foreign Application Priority Data

Apr. 13, 2010 (JP) ..... 2010-092222

(51) Int. Cl.
*H01R 13/648* (2006.01)

(52) U.S. Cl. ..... 439/101

(58) Field of Classification Search ..... 439/101, 439/108, 607.08, 607.39, 607.47
See application file for complete search history.

(56) References Cited

U.S. PATENT DOCUMENTS

| | | | | |
|---|---|---|---|---|
| 6,280,209 | B1 * | 8/2001 | Bassler et al. | 439/101 |
| 6,945,796 | B2 | 9/2005 | Bassler et al. | |
| 7,524,209 | B2 * | 4/2009 | Hull et al. | 439/607.01 |
| 7,670,199 | B2 * | 3/2010 | Nagata et al. | 439/92 |
| 7,806,704 | B2 * | 10/2010 | Miyoshi et al. | 439/108 |
| 2010/0112832 | A1 * | 5/2010 | Sato et al. | 439/78 |
| 2011/0014819 | A1 * | 1/2011 | Yamakami et al. | 439/676 |

FOREIGN PATENT DOCUMENTS

JP 2005-005272 1/2005

* cited by examiner

*Primary Examiner* — Tulsidas C Patel
*Assistant Examiner* — Phuongchi Nguyen
(74) *Attorney, Agent, or Firm* — IPUSA, PLLC

(57) ABSTRACT

A connector includes first and second connector parts to be connected to each other. A plate-like terminal provided in the first connector part is maintained at a power supply voltage or a ground potential. A plug connected to a signal line is supported by a first insulation part provided on the plate like terminal. The plug includes a protrusion part protruding from the first insulation part. A first terminal is configured by a plate spring supported by a second insulation part provided in the second connector part. The first terminal has an extreme end part to be engaged with a side surface of the protrusion part when the first and second connector parts are connected to each other. A second terminal for power supply or ground is supported by the second insulation part to contact with the plate-like terminal when the first and second connector parts are connected to each other.

7 Claims, 8 Drawing Sheets

CONNECTOR HAVING A PLUG ARRANGED ABOVE A PLATE-LIKE TERMINAL

CROSS-REFERENCE TO RELATED APPLICATIONS

This application is based upon and claims the benefit of priority of the prior Japanese Patent Application No. 2010-092222, filed on Apr. 13, 2010, the entire contents of which are incorporated herein by reference.

FIELD

The embodiment discussed herein is directed to a connector for transmitting a radio frequency signal.

BACKGROUND

There are various kinds of connector for transmitting a radio frequency signal such as a connector disclosed in Japanese Laid-Open Patent Application No. 2005-005272.

In many conventional connectors, when a plug side and a socket side are connected to each other, terminals for connecting signal lines are displaced in a direction in which a distance between the signal terminals and a ground part is changed. Thus, there may be a variation in a height of the signal terminals connected to a plurality of signal terminals and a height of the ground terminals.

The variation in the height of the signal terminals and the ground terminals may cause a variation or a mismatch in a characteristic impedance of the signal terminals. Thereby, it is possible that signal deterioration occurs and a signal loss is increased, which may result in a problem generated in a high-speed signal transmission.

Thus, there is a demand for providing a connector having an excellent signal transmission characteristic in a high-speed signal transmission.

SUMMARY

According to an aspect of the invention, a connector includes a first connector part and a second connector part to be connected to each other, the connector comprising: a plate-like terminal provided in the first connector part, the plate-like terminal being maintained at a power supply voltage or a ground potential; a first insulation part provided on the plate-like terminal; a plug supported by the first insulation part and connected to a signal line, the plug including a protrusion part protruding from the first insulation part; a second insulation part provided in the second connector part; a first terminal configured by a plate spring supported by the second insulation part, the first terminal having an extreme end part to be engaged with a side surface of the protrusion part of the plug when the first connector part and the second connector part are connected to each other; and a second terminal for power supply or ground supported by the second insulation part, the second terminal configured to contact with the plate-like terminal when the first connector part and the second connector part are connected to each other.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENT(S)

Preferred embodiments of the present invention will be explained with reference to the accompanying drawings.

First Embodiment

Figure 1A:
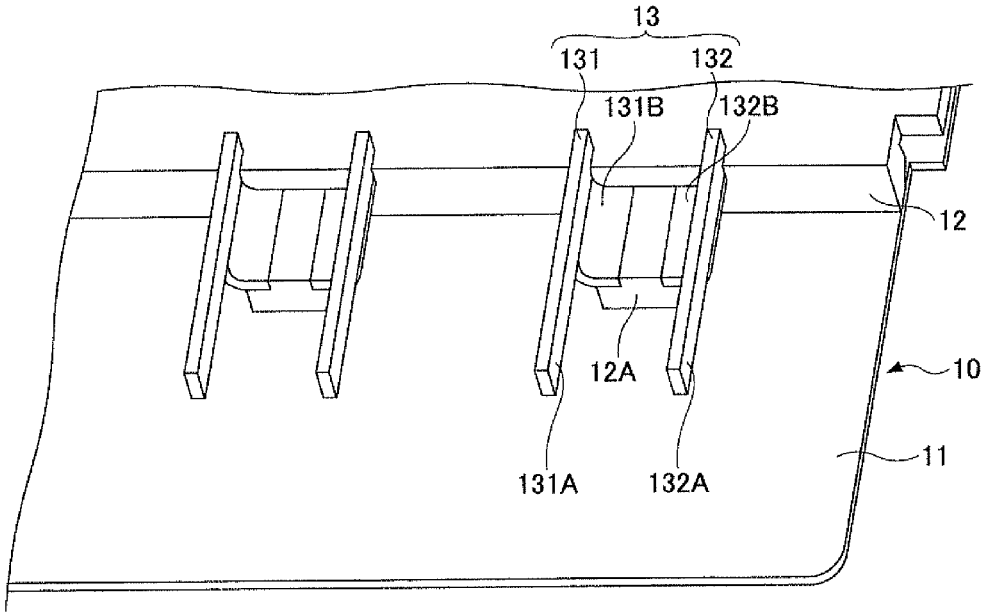
FIG. 1A is a perspective view of a connector part of a connector according to a first embodiment.
Figure 1B:
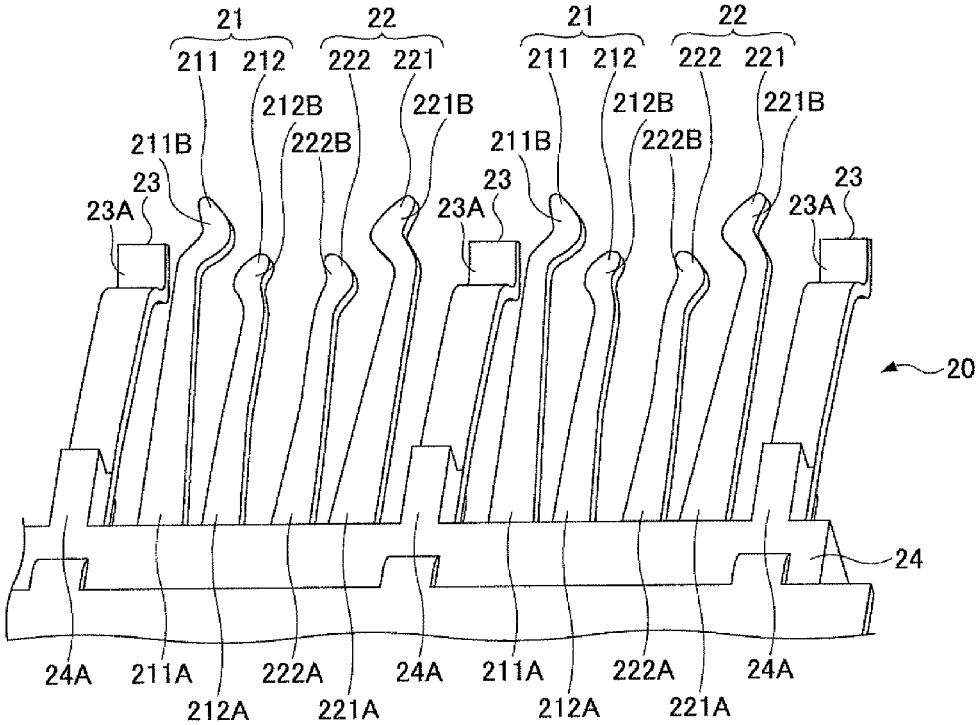
FIG. 1B is a perspective view of another connector part of the connector according to the first embodiment.

A description will be given below of a first embodiment. FIGS. 1A and 1B are perspective view of parts of a connector 100 according to the first embodiment. FIG. 1A illustrates a connector part 10 of the connector 100, and FIG. 1B illustrates a connector part 20 of the connector 100.

The connector part 10 is a plug-type connector part including a plate-like terminal 11, a first insulation part 12 and a plurality of plugs 13. The plate-like terminal 11 and the plugs 13 are supported by the first insulation part 12 by one side of each of the terminals 11 and the plugs 13 being insert-molded into the first insulation part 12. Although two plugs 13 are illustrated in FIG. 1A, three or more plugs 13 may be provided in the connector part 10.

The plate-like terminal 11 is formed of, for example, a copper plate, and is maintained at a power supply potential or a ground potential.

The first insulation part 12 is arranged on the plate-like terminal 11, and is formed of an insulation material such as a resin material. The first insulation part 12 has a support part 12A for supporting the plugs 13 above the plate-like terminal 11. The first insulation part 12 electrically isolates the plugs 13 from the plate-like terminal 11.

Each of the plugs 13 is made of copper and includes a pair of plug parts 131 and 132. The plug parts 131 and 132 are supported by the support part 12A of the first insulation part 12 to extend from the first support part 12A above the plate-like terminal 11. The plug parts 131 and 132 are insulated from each other and are connected to signal lines (not illustrated in the figure) through the interior of the first insulation part 12.

The plug parts 131 and 132 have protrusion parts 131A and 132A, respectively. The protrusion parts 131A and 132A are bent from the respective support parts 131B and 132B that are supported by the first insulation part 12. Thus, the direction of width of each of the projection parts 131A and 132A is perpendicular to the plate-like terminal 11.

Each of the plugs 13 can be used for transmitting radio frequency signals having different phases through the plug parts 131 and 132.

The connector part 20 illustrated in FIG. 1B includes first terminals 21, second terminals 22, the grand terminals 23 and a second insulation part 24. The first terminal 21, the second terminals 22 and the grand terminals 23 are made of, for example, copper, and are supported by the second insulation part 24 by one side of each of the first terminals 21, the second terminals 22 and the grand terminals 23 being insert-molded into the second insulation part 24.

Each of the first terminals 21 has terminal parts 211 and 212. The terminal parts 211 and 212 are connected to each other by a connection part embedded in the second insulation part 24 so that the terminal parts 211 and 212 form a U-shaped plate spring in a plan view. In the present embodiment, the terminal part 211 is longer than the terminal part 212.

The terminal parts 211 and 212 are supported by the second insulation part 24 so that, when the connector part 10 and the connector part 20 are connected to each other, the terminal parts 211 and 212, which are from base parts 211A and 212A to end parts 211B and 212B, are parallel to the plate-like terminal 11. That is, the entire terminal parts 211 and 212 are at an equal distance from the plate-like terminal 11.

Each of the second terminals 22 has a structure in which the left and right of the first terminal 21 are counterchanged. That is, each of the second terminals 22 has terminal parts 221 and 222 that are connected by a connection part embedded in the second insulation part 24 so that the terminal parts 221 and 222 form a U-shaped plate spring in a plan view. In the present embodiment, the terminal part 221 is longer than the terminal part 222.

The terminal parts 221 and 222 are supported by the second insulation part 24 so that, when the connector part 10 and the connector part 20 are connected to each other, the terminal parts 221 and 222, which are from base parts 221A and 222A to end parts 221B and 222B, are parallel to the plate-like terminal 11. That is, the entire terminal parts 221 and 222 are at an equal distance from the plate-like terminal 11.

The first terminal 21 and the second terminal 22 are terminals electrically connected to the plug parts 131 and 132 of the connector part 10 by being brought into engagement with the plug parts 131 and 132 when the connector part 10 and the connector part 20 are connected to each other.

Each of the ground terminals 23 is a plate spring supported by a protrusion part 24A of the second insulation part 24 so that the ground part 24A can be elastically bent in a direction perpendicular to a longitudinal direction thereof. The ground terminal 23 has a bent part 23A at an extreme end thereof so that the bent part 23A is brought into contact with and electrically connected to the surface of the plate-like terminal 11 when the connector part 10 and the connector part 20 are connected to each other.

Figure 2:
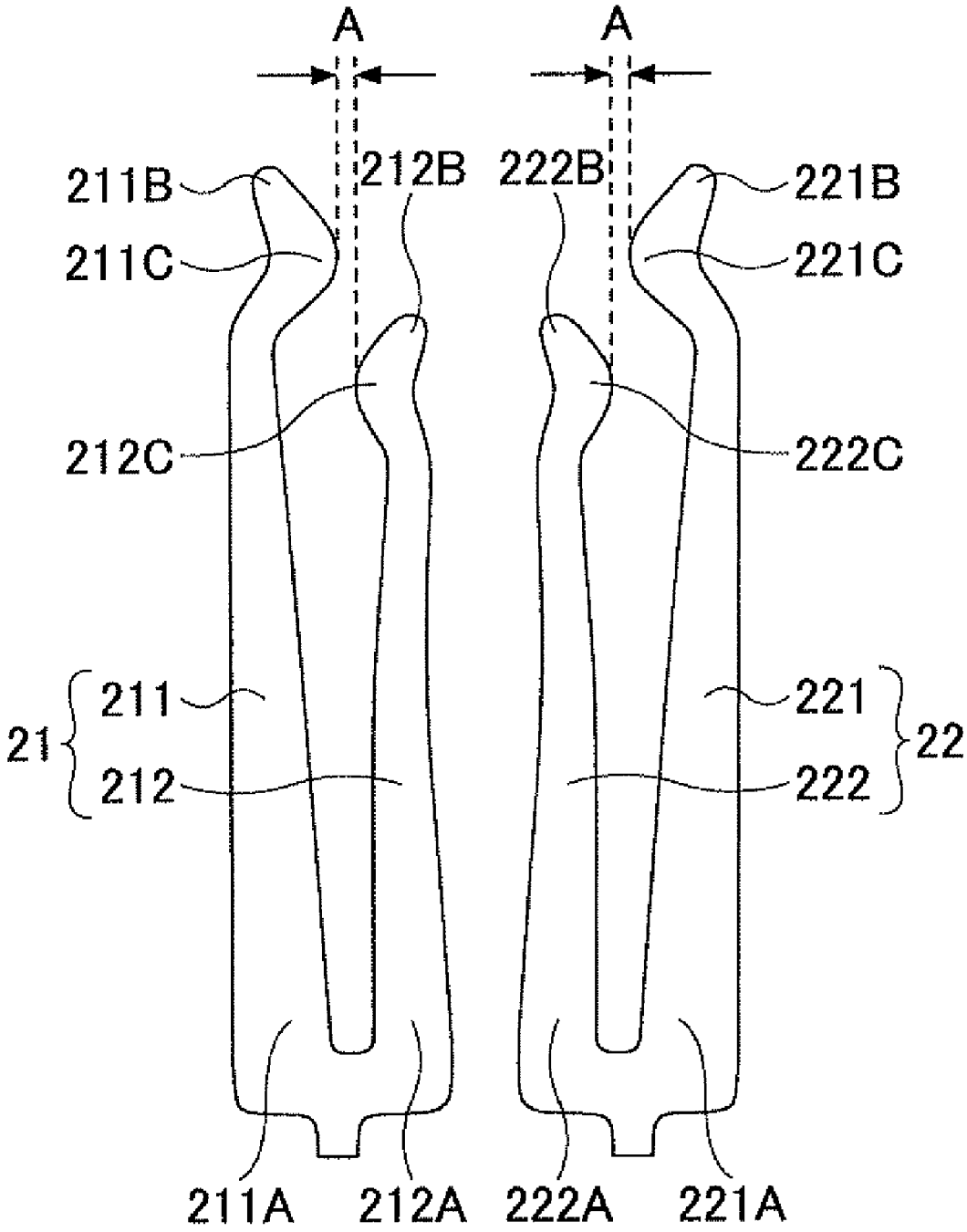
FIG. 2 is a plan view of a first terminal and a second terminal of the connector according to the first embodiment.

A description is given in detail, with reference to FIG. 2, of the structures of the first terminal 21 and the second terminal 22. FIG. 2 is a plan view illustrating the first terminal 21 and the second terminal 22 of the connector 100 according to the first embodiment.

As illustrated in FIG. 2, each of the first terminal 21 and the second terminal 22 forms a U-shaped plate spring. The terminal parts 211 and 212 have protrusion parts 211C and 212C, which extend toward each other, near the extreme end parts 211B and 212B, respectively. The protrusion parts 211C and 212C are brought into contact with the protrusion part 131A of the plug part 131 when the connector part 10 and the connector part 20 are connected to each other.

Because the first terminal 21 is a U-shaped plate spring, an interval A between protrusion parts 211C and 212C is set smaller than the width of the protrusion part 131A of the plug part 131. This is the same as the second terminal 22. That is, an interval A between protrusion parts 221C and 222C is set smaller than the width of the protrusion part 131B of the plug part 131.

Figure 3A:
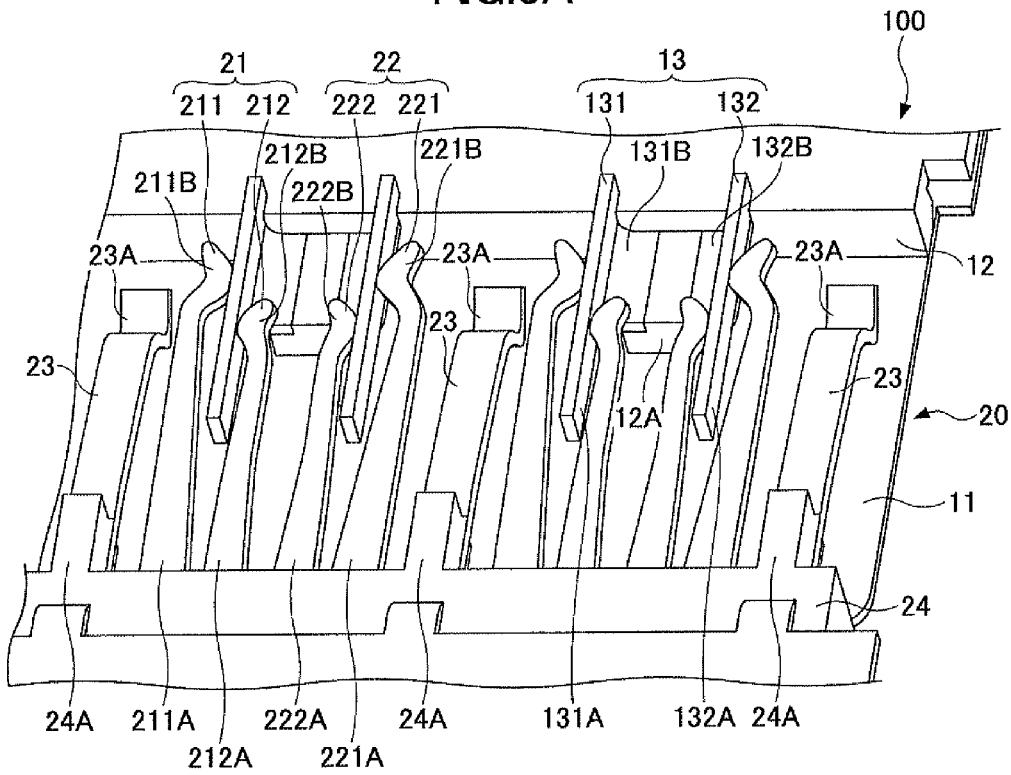
FIG. 3A is a perspective view of the connector parts that are connected to each other.
Figure 3B:
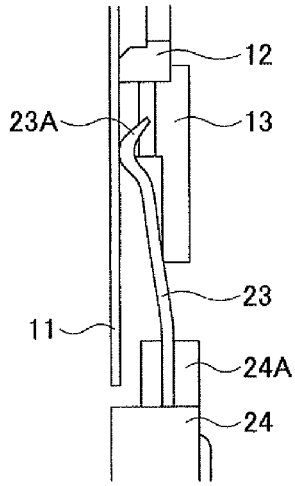
FIG. 3B is a side view of a plug and a ground terminal when the connector parts are connected to each other.

A description is given below of a state where the connector part 10 and the connector part 20 are connected to each other. FIG. 3A is a perspective view of the connector part 10 and the connector part 20 that are connected to each other. FIG. 3B is a side view of the plug 13 and the ground terminal 23 when the connector part 10 and the connector part 20 are connected to each other.

When the connector part 10 and the connector part 20 are connected as illustrated in FIG. 3A, the terminal parts 211 and 212 of the first terminal 21 are engaged with the both sides of the protrusion part 131A of the plug 13, and the terminal parts 221 and 222 of the second terminal 22 are engaged with both sides of the protrusion part 132A of the plug 13. In this state, the U-shaped plate springs of the first terminal 21 and the second terminal 22 are in a state where they are broadened, and, thereby, the terminal parts 211 and 212 of the first terminal 21 are in close contact with the protrusion part 131A and the terminal parts 221 and 222 of the second terminal 22 are in close contact with the protrusion part 132A.

As illustrated in FIG. 3B, the bent part 23A at the extreme end of the ground terminal 23 is in close contact with the surface of the plate-like terminal 11. Moreover, the plate-like terminal 11 has a size to reach the second insulation part 24 in the state where the connector part 10 and the connector part 20 are connected to each other. Thus, the plate-like terminal 11 has a size, which covers an area including the terminal parts 211 and 212 and the ground terminal 23.

Thus, according to the connector 100 of the first embodiment, an electrical connection can be achieved between the plug part 131 of the plug 13 and the first terminal 21, between the plug part 132 of the plug 13 and the second terminal 22, and between the plate-like terminal 11 and the ground terminal 23 in a state where the connector part 10 and the connector part 20 are connected to each other.

The first terminal 21 and the second terminal 22 connected to the plug 13 can be used for transmitting radio frequency signals. When connecting the connector part 10 and the connector part 20 to each other, the first terminal 21 and the second terminal 22 are displaced in directions parallel to the plate-like terminal 11. Thus, by forming the connector part 20 with the first terminal 21 and the second terminal 22 being arranged at the same level (at the same height), a variation in heights of the first terminal 21 and the second terminal 22 with respect to the plate-like terminal 11 can be suppressed when the connector part 10 and the connector part 20 are connected to each other. Thereby, a variation and mismatch in the characteristic impedance between the first terminal 21 and the second terminal 22 can be suppressed.

Moreover, signal deterioration and an increase in a signal loss can be suppressed, thereby providing the connector 100 having an excellent signal transmission characteristic at a high-speed transmission.

Moreover, the first terminal 21 and the second terminal 22 have the terminal parts 211 and 212 and the terminal parts 221 and 222 having different lengths to each other, respectively. The length of the terminal parts 211 and 221 and the length of the terminal parts 212 and 222 may be set to the same length. However, by differentiating the lengths of the terminal parts 211 and 221 and the lengths of the terminal parts 212 and 222, a timing at which the terminal parts 211 and 221 are brought into engagement with the plug parts 131 and 132 can be shifted from a timing at which the terminal parts 212 and 222 are brought into engagement with the plug parts 131 and 132. Thereby, forces applied to the plug parts 131 and 132 by the terminal parts 211, 212, 221 and 222, when the connector part 10 and the connector part 20 are connected to each other, can be reduced, which facilitates an easy engagement of the plugs 131 and 132 of the plug 13. Additionally, because a smaller force is applied to the plug parts 131 and 132 of the plug 13 when connecting the connector part 10 and the connector part 20, the plug parts 131 and 132 of the plug 13 can be made thinner.

Because the plate-like terminal 11 has a size to cover an area including the terminal parts 211 and 212 and the ground terminal 23 in the state where the connector part 10 and the connector part 20 are connected to each other, when a plurality of connectors 100 are arranged one on another, the adjacent connectors 100 can be shielded from each other by the plate-like terminal 11. Thus, the terminal parts 211 and 212 and the ground terminals 23 of the adjacent connectors 100 can be prevented from cross-talking, which provides the connector 100 having an excellent signal transmission characteristic at a high-speed transmission.

Moreover, because the first terminal 21 and the second terminal 22, which are connected to the plug 13, are arranged between the adjacent ground terminals 23 in a plan view, when a large number of the first terminals 21, the second terminals 22 and the ground terminals 23 are arranged in a transverse direction of the connector 100, the first terminals 21 and the second terminals 22 are prevented from cross-talking to each other.

Second Embodiment

Figure 4A:
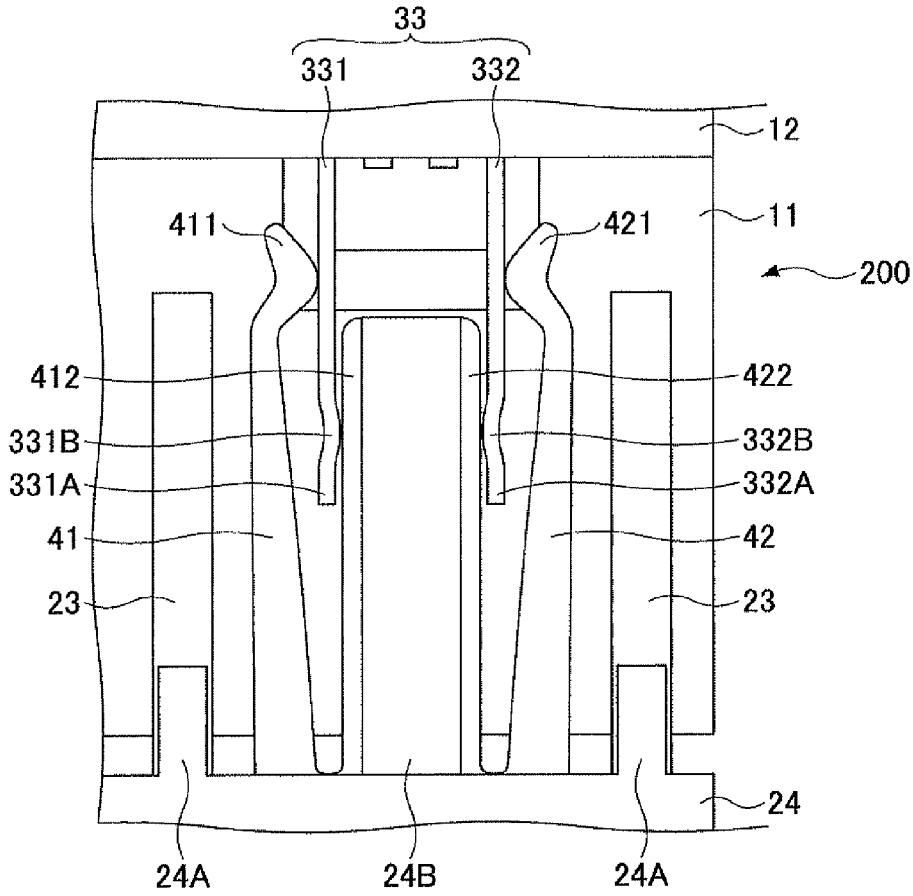
FIG. 4A is a plan view of a part of a connector according to a second embodiment.
Figure 4B:
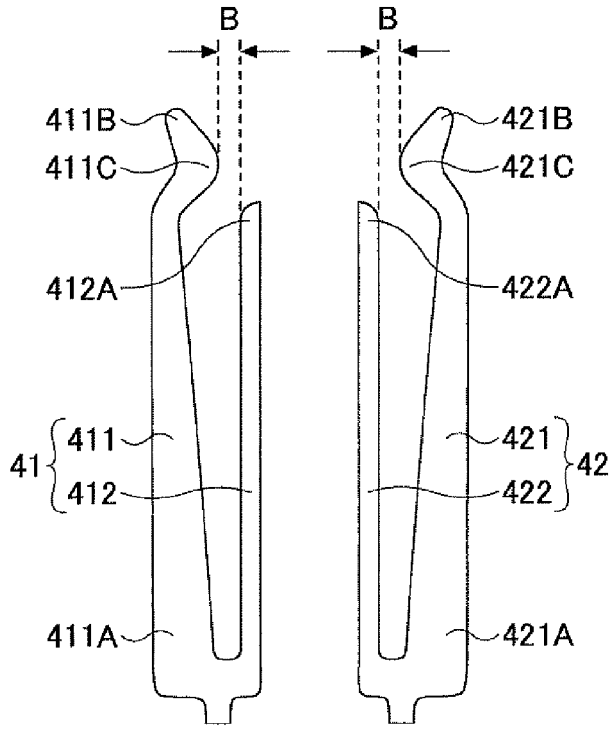
FIG. 4B is a plan view of a first terminal and a second terminal provided in the connector according to the second embodiment.

FIG. 4A is a plan view of a part of a connector 200 according to a second embodiment. FIG. 4B is a plan view of a first terminal 41 and a second terminal 42 provided in the connector 200.

The connector 200 according to the second embodiment includes a plug 33 and the first terminal 41 and the second terminal 42 having different shapes from those of the connector 100 according to the first embodiment. Other parts of connector 200 are the same as the parts of the connector 100, and are given the same reference numerals and descriptions thereof will be omitted.

A description of the connector 200 is given below by focusing on differences between the structures of the plug 33, the first terminal 41 and the second terminal 42 and the structures of the plug 13, the terminal 21 and the second terminal 22.

The plug 33 is supported by the first insulation part 12 as illustrated in FIG. 4A. The first terminal 41 and the second terminal 42 are supported by the second insulation part 24.

Bent parts 331B and 332B are formed on protrusion parts 331A and 332A of the plug parts 331 and 332, respectively. The bent parts 331B and 332B are bent so that tops of the bent parts are positioned to be closer to each other.

As illustrated in FIG. 4B, the first terminal 41 includes terminal parts 411 and 412. The first terminal 41 is formed by a U-shaped plate spring in a plan view. The structure of the terminal part 411 is the same as the terminal part 211 of the above-mentioned first embodiment, but the terminal part 412 has a linear shape, which is different from the terminal part 212. The terminal part 411 is formed to be longer than the terminal part 412.

An interval B between a protrusion part 411C, which is formed near the extreme end part 411B on a side of a base part 411A, and an extreme end part 412A of the terminal part 412 is set smaller than a width of the plug part 331 including the protrusion part 331A.

Similarly, the second terminal 42 includes terminal parts 421 and 422. The second terminal 42 is formed by a U-shaped plate spring in a plan view. The structure of the terminal part 421 is the same as the terminal part 221 of the above-mentioned first embodiment, but the terminal part 422 has a linear shape, which is different from the terminal part 222. The terminal part 421 is formed to be longer than the terminal part 422.

An interval B between a protrusion part 421C, which is formed near the extreme end part 421B on a side of a base part 421A, and an extreme end part 422A of the terminal part 422 is set smaller than a width of the plug part 332 including the protrusion part 332A.

Additionally, as illustrated in FIG. 4A, a protrusion part 24B of the second insulation part 23 is provided between the terminal part 412 of the first terminal 41 and the terminal part 422 of the second terminal 42. The protrusion part 24B supports the terminals 412 and 422.

A description will be given in detail, with reference to FIGS. 5A and 5B and FIGS. 6A and 6B, of a method of connecting the connector parts 210 and 220 of the connector 200 according to the second embodiment. FIGS. 5A and 5B and FIGS. 6A and 6B illustrate sequential movement of the first terminal 41 and the second terminal 42 when connecting the connector parts 210 and 220 of the connector 200 to each other.

Figure 5B:
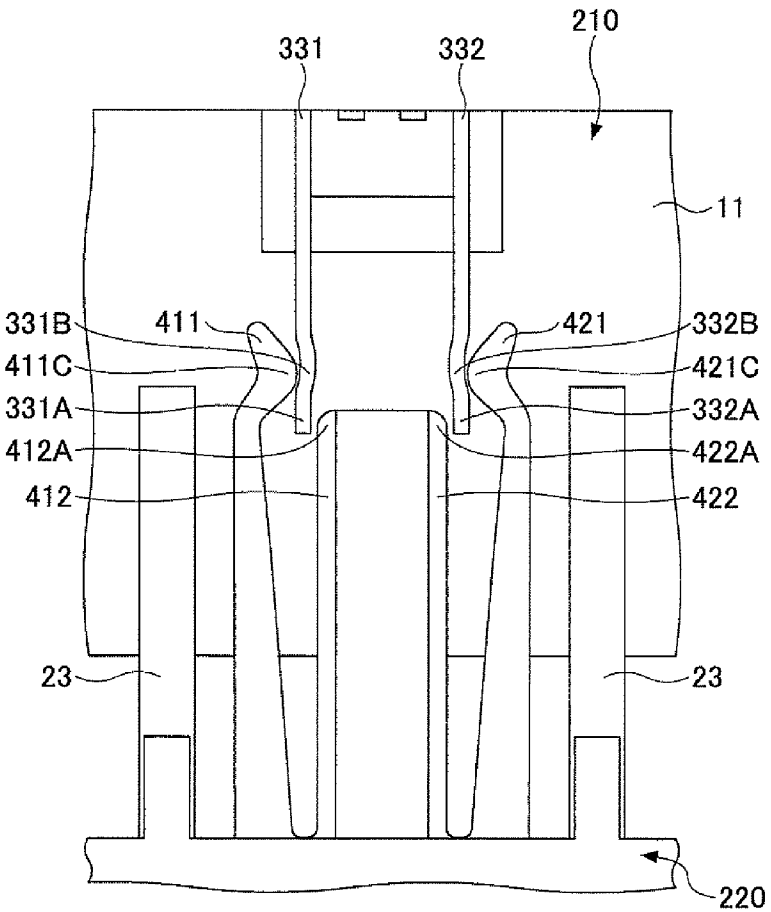
FIG. 5B is a plan view of the first terminal and the second terminal in a middle of the connecting operation of the connector parts.
Figure 5A:
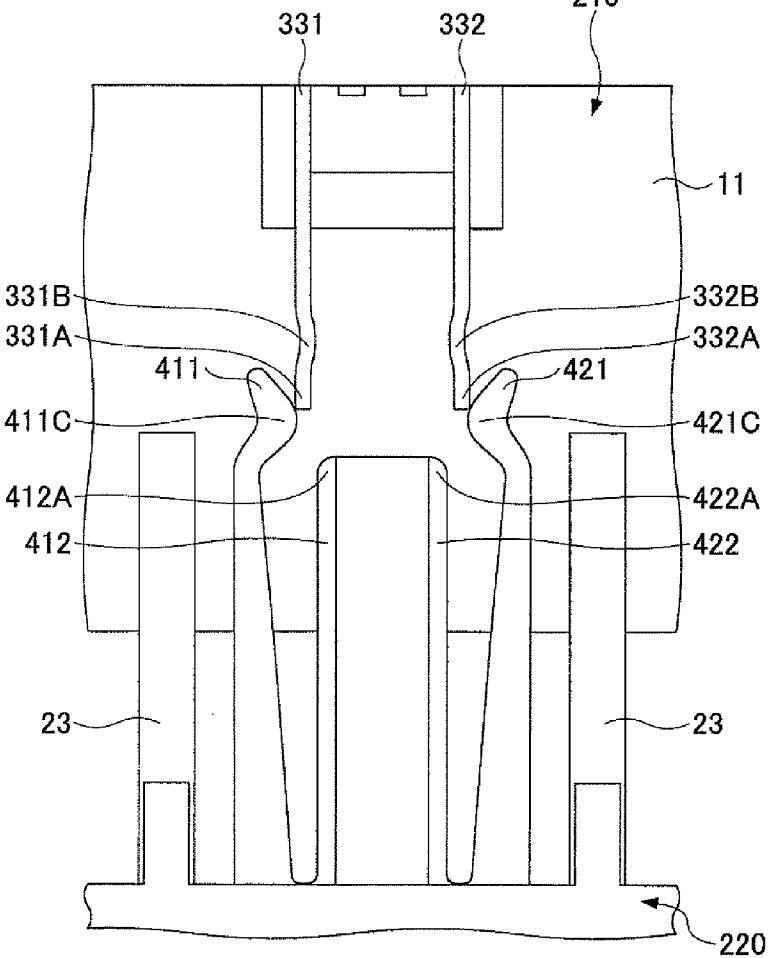
FIG. 5A is a plan view of the first terminal and the second terminal at a beginning of a connecting operation of the connector parts of the connector according to the second embodiment.

In the state illustrated in FIG. 5A, extreme ends of the protrusion parts 331A and 332A of the plug parts 331 and 332 of the plug 33 are in contact with the protrusion parts 411C and 421C of the terminal parts 411 and 421, respectively. At this stage, the terminal parts 412 and 422 of the connector part 220 are not in contact with the plug parts 331 and 332 of the plug 33 of the connector part 210. When the connector part 210 and the connector part 220 are further moved closer to each other, the terminal parts 412 and the terminal parts 422 are displaced in directions in which the plate springs are broadened (opened).

In the state illustrated in FIG. 5B, the protrusion parts 411C and 421C are engaged with outer side surfaces of the bent parts 331B and 332B, respectively. When the protrusion parts 411A and 421C are brought into engagement with the bent parts 331B and 332B, the plug parts 331 and 332 of the plug 33 (formed by plate springs) return toward the initial positions (move in closing directions) by distances corresponding to the bent parts 331B and 332B, respectively.

Figure 6B:
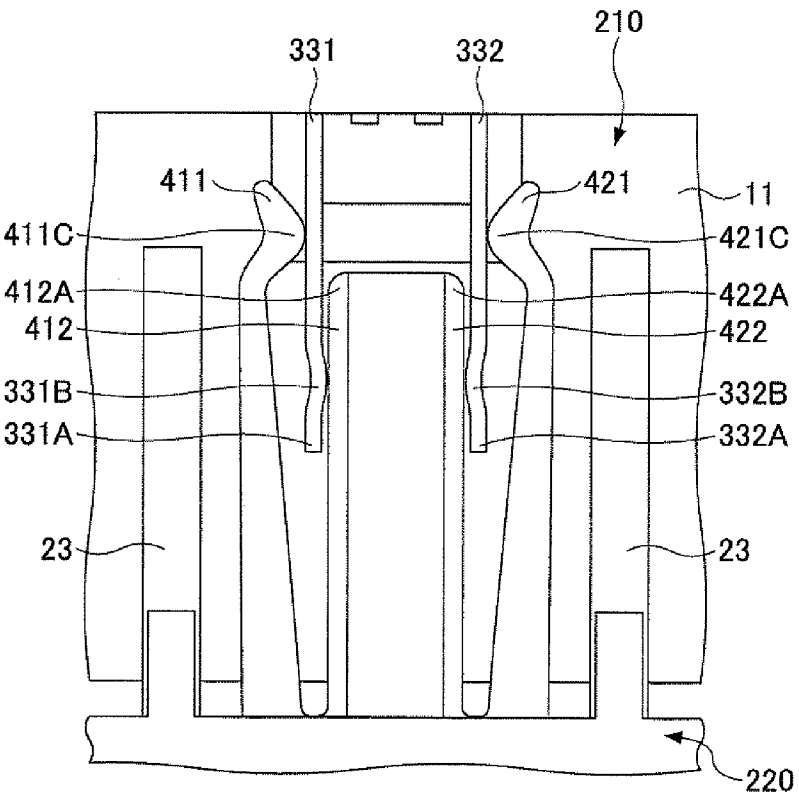
FIG. 6B is a plan view of the first terminal and the second terminal in at an end of the connecting operation of the connector parts.
Figure 6A:
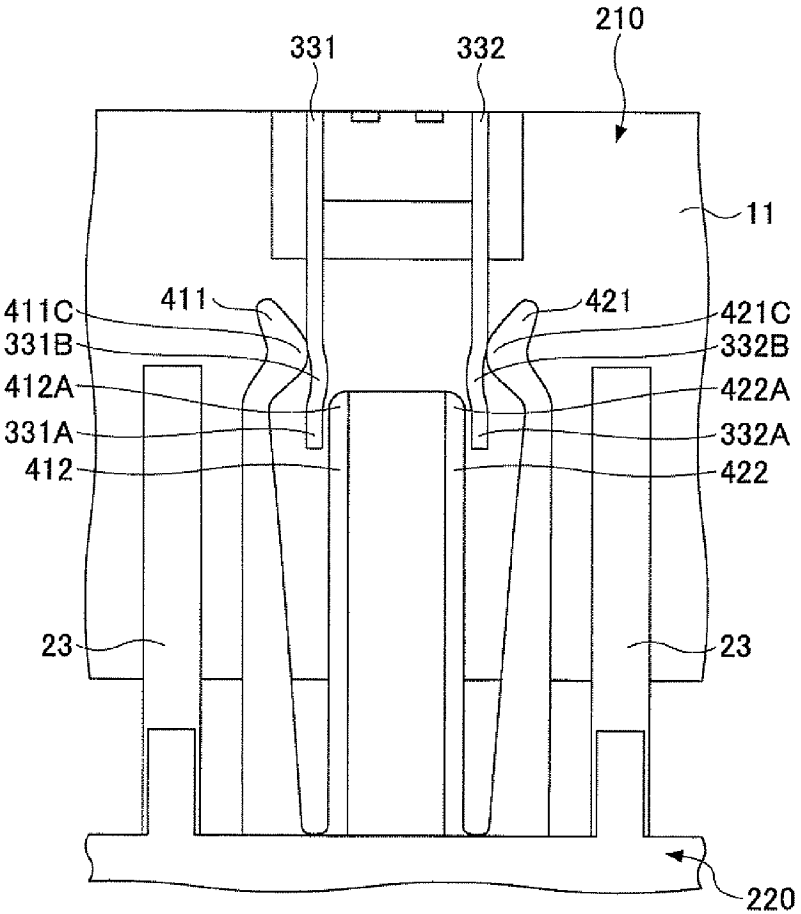
FIG. 6A is a plan view of the first terminal and the second terminal in a middle of the connecting operation of the connector parts.

In the state illustrated in FIG. 6A, the protrusion parts 411C and 421C passed through the bent parts 331B and 332B, and the extreme end parts 412A and 422A of the terminal parts 412 and 422 move to positions close to inner surfaces of the bent parts 331B and 332B, respectively.

In the state illustrated in FIG. 6B, the connector part 210 and the connector part 220 are connected completely to each other.

As mentioned above, lengths of the terminal parts 411 and 412 and positions of the protrusion parts 411C and the extreme end part 412A are set so that a timing of the terminal part 411 being brought into contact with the plug part 331 differs from a timing of the terminal part 412 being brought into contact with the plug part 331.

Similarly, lengths of the terminal parts 421 and 422 and positions of the protrusion parts 421C and the extreme end part 422A are set so that a timing of the terminal part 421 being brought into contact with the plug part 332 differs from a timing of the terminal part 422 being brought into contact with the plug part 332.

Thereby, the distance between the terminal part 412 and the terminal part 422 can be reduced because the terminal part 412 and the terminal part 422 provide nonmovable contact points. Additionally, a distance between the plug 331 and the plug 332 of the plug 33 can also be reduced, which enables miniaturization of the connector 200.

Thus, according to the connector 200 of the second embodiment, an electrical connection can be achieved between the plug part 331 of the plug 33 and the first terminal 41, between the plug part 332 of the plug 33 and the second terminal 42, and between the plate-like terminal 11 and the ground terminal 23 in a state where the connector part 210 and the connector part 220 are connected to each other.

The first terminal 41 and the second terminal 42 connected to the plug 33 can be used for transmitting radio frequency signals. When connecting the connector part 210 and the connector part 220 to each other, the first terminal 41 and the second terminal 42 are displaced in directions parallel to the plate-like terminal 11. Thus, by forming the connector part 220 with the first terminal 41 and the second terminal 42 being arranged at the same level (at the same height), a variation in heights of the first terminal 41 and the second terminal 42 with respect to the plate-like terminal 11 can be suppressed when the connector part 210 and the connector part 220 are connected to each other. Thereby, a variation and mismatch in the characteristic impedance between the first terminal 41 and the second terminal 42 can be suppressed.

Moreover, signal deterioration and an increase in a signal loss can be suppressed, thereby providing the connector 200 having an excellent signal transmission characteristic at a high-speed transmission.

Third Embodiment

Figure 7A:
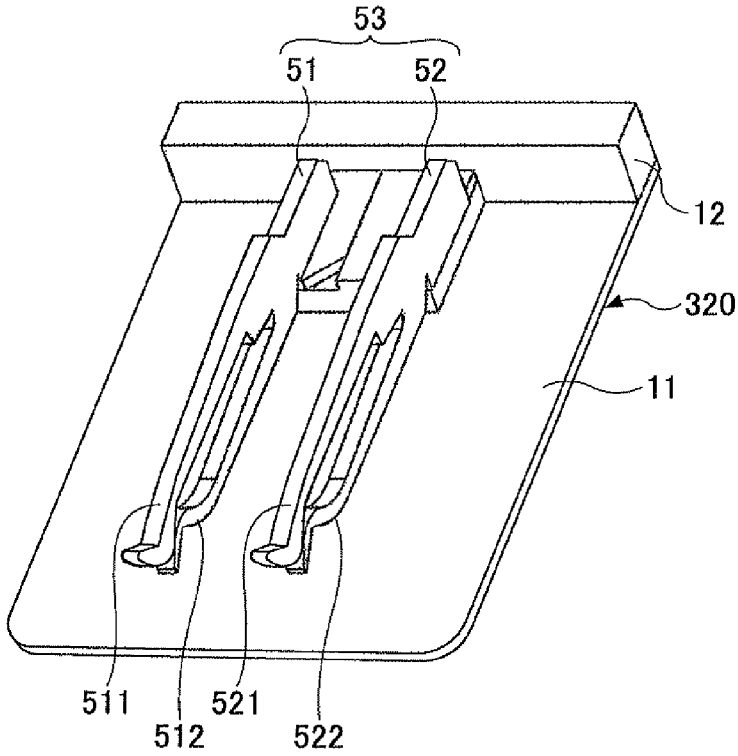
FIG. 7A is a perspective view of a connector part of a connector according to a third embodiment.
Figure 7B:
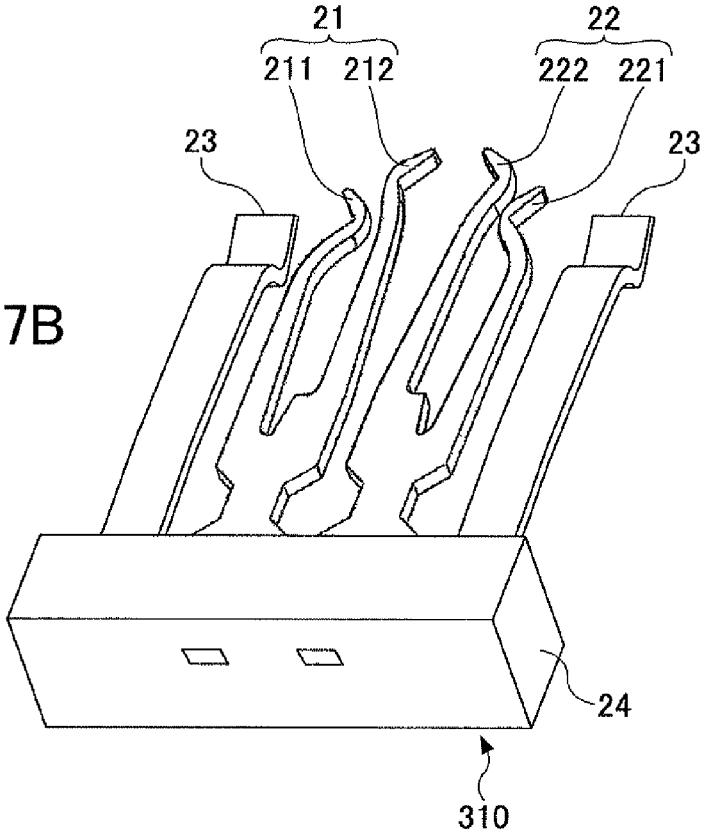
FIG. 7B is a perspective view of a connector part of the connector according to the third embodiment.

FIG. 7A is a perspective view of a connector part 320 of a connector 300 according to a third embodiment. FIG. 7B is a perspective view of a connector part 310 of the connector 300 according to the third embodiment.

The connector 300 according to the third embodiment includes a plug 53 having the same configuration as the first terminal and the second terminal of the first embodiment. Other parts of the connector 300 are the same as the parts of the connector 100, and are given the same reference numerals and descriptions thereof will be omitted.

The connector part 310 illustrated in FIG. 7B has the same structure as the connector part 10 according to the first embodiment. On the other hand, the connector part 320 illustrated in FIG. 7A includes the plug 53 having the plug parts 51 and 52 of the same configuration as the first terminal 21 and the second terminal 22 included in the connector part 310.

As illustrated in FIG. 7A, the plug part 51 has terminal parts 511 and 512. The terminal part 511 and the terminal part 512 are connected in a base part, and configured to be a U-shaped plate spring in plan view. The terminal part 511 is formed to be longer than the terminal part 512. The shape of the plug part 51, which is configured to be a U-shaped plate spring, is the same as the first terminal 21 and the second terminal 22 illustrated in FIG. 2. Because the plug part 51 is connected to the first terminal 21 illustrated in FIG. 7B, the plug part 51 is supported by the first insulation part 12 in a state where the plug part 51 is rotated by 90 degrees relative to the first terminal 21.

Similarly, the plug part 52 has terminal parts 521 and 522. The terminal part 521 and the terminal part 522 are connected in a base part, and configured to be a U-shaped plate spring in plan view. The terminal part 521 is formed to be longer than the terminal part 522. The shape of the plug part 52, which is configured to be a U-shaped plate spring, is the same as the first terminal 21 and the second terminal 22 illustrated in FIG. 2. Because the plug part 52 is connected to the first terminal 22 illustrated in FIG. 7B, the plug part 52 is supported by the first insulation part 12 in a state where the plug part 52 is rotated by 90 degrees relative to the second terminal 22.

Figure 8:
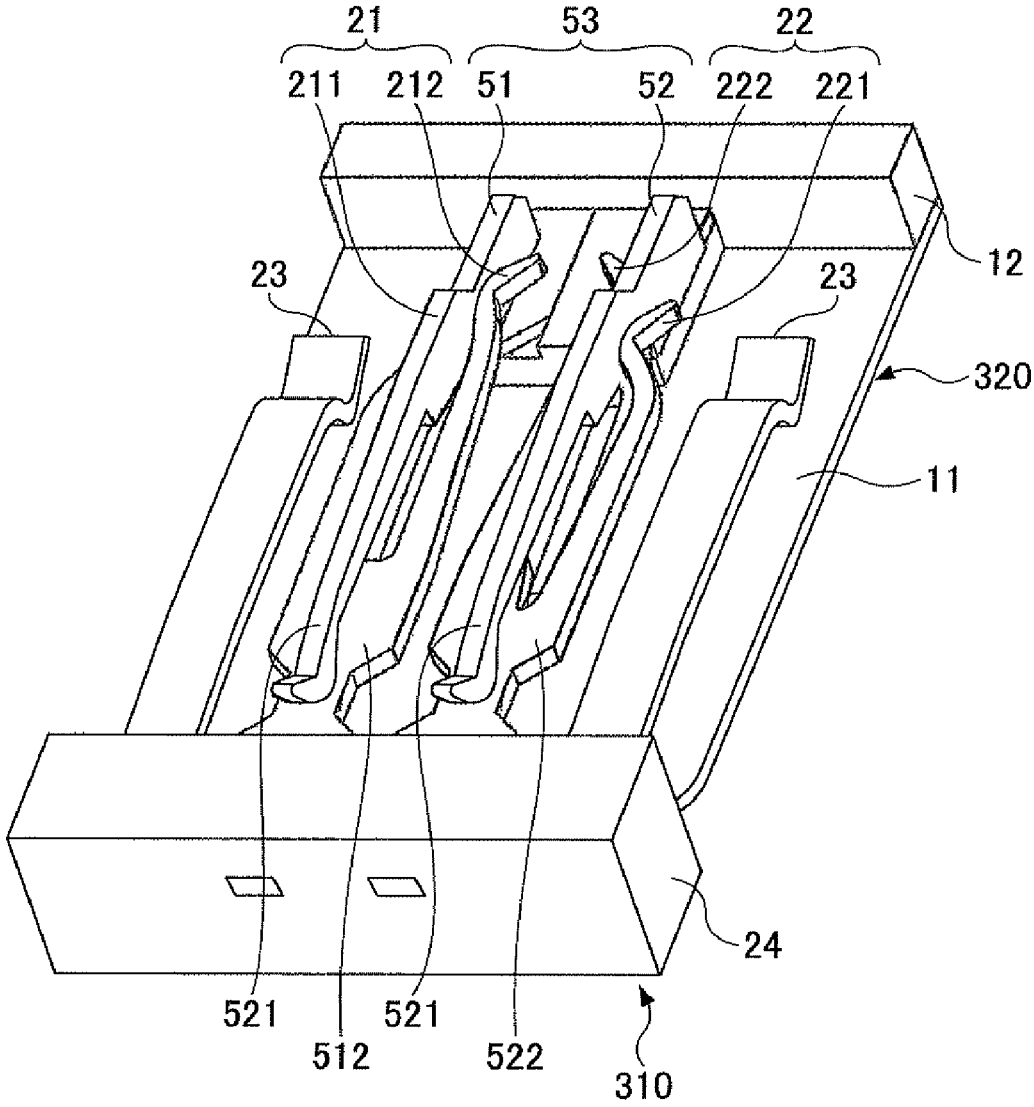
FIG. 8 is a perspective view of the connector according to the third embodiment in a connected state.

When the thus-configured connector parts 310 and 320 are connected to each other, as illustrated in FIG. 8, the plug parts 51 and the first terminal 21 are brought into contact and connected with each other, and the plug part 52 and the second terminal 22 are brought into contact and connected with each other.

Thus, according to the connector 300 of the third embodiment, an electrical connection can be achieved between the plug part 51 of the plug 53 and the first terminal 21, between the plug part 52 of the plug 53 and the second terminal 22, and between the plate-like terminal 11 and the ground terminal 23 in a state where the connector part 310 and the connector part 320 are connected to each other.

Additionally, if the connector part 320 is produced with the first terminal 21 and the second terminal 22 being arranged at the same level (the same height) and connector part 310 is produced with the plug part 51 and the plug part 52 being arranged at the same level (the same height), the same connection state can be achieved between the first terminal and the plug part 51 and between the second terminal 22 and the plug part 52 when the connector part 310 and the connector part 320 are connected to each other. Thereby, a variation in the connection state can be suppressed. Thereby, a variation and mismatch in the characteristic impedance between the first terminal 21 and the second terminal 22 can be suppressed.

Moreover, signal deterioration and an increase in a signal loss can be suppressed, thereby providing the connector 300 having an excellent signal transmission characteristic at a high-speed transmission.

Additionally, the first terminal 21 and the second terminal 22 include terminal parts 211 and 212 having different lengths and terminal parts 221 and 222 having different lengths, respectively. Also, the plug part 51 and the plug part 52 include terminal parts 511 and 512 having different lengths and terminal parts 521 and 522 having different lengths. Thereby, the connector part 310 and the connector part 320 can be connected easily to each other.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention (s) has (have) been described in detail, it should be understood that the various changes, substitutions, and alterations could be made hereto without departing from the spirit and scope of the invention.

What is claimed is:

1. A connector including a first connector part and a second connector part to be connected to each other, the connector comprising:

a plate-like terminal provided in said first connector part, the plate-like terminal being maintained at a power supply voltage or a ground potential;

a first insulation part provided on said plate-like terminal;

a plug supported by said first insulation part and connected to a signal line, the plug including a protrusion part protruding from said first insulation part;

a second insulation part provided in said second connector part;

a first terminal configured by a plate spring supported by said second insulation part, the first terminal having an extreme end part to be engaged with a side surface of said protrusion part of said plug when said first connector part and said second connector part are connected to each other; and a second terminal for power supply or ground supported by said second insulation part, the second terminal configured to contact with said plate-like terminal when said first connector part and said second connector part are connected to each other.

2. The connector as claimed in claim 1, wherein said first terminal is configured so that said extreme end part is brought into engagement with a side surface of said protrusion part of said plug, when said first connector part and said second connector part are connected to each other, by said first terminal being broadened in directions parallel to said plate-like terminal.

3. The connector as claimed in claim 1, wherein said plate-like terminal has a size that covers an area including said first terminal and said second terminal protruding from said second insulation part in a plan view.

4. The connector as claimed in claim 1, wherein said protrusion part of said plug is configured so that a direction of width of said protrusion part is perpendicular to said plate-like terminal.

5. The connector as claimed in claim 1, wherein two pieces of said first terminal supported by said second insulation part are arranged between two pieces of said second terminal supported by said second insulation part.

6. The connector as claimed in claim 1, wherein said first terminal includes a pair of said extreme end part to engage with both side surfaces of said protrusion part of said plug by sandwiching said protrusion part of said plug between said pair of said extreme end parts.

7. The connector as claimed in claim 6, wherein said pair of said extreme end parts have different protruding lengths from said second insulation part.

* * * * *